US005417723A

United States Patent [19]

Träubel et al.

[11] Patent Number: 5,417,723

[45] Date of Patent: May 23, 1995

[54] USE OF ESTER URETHANES FOR RETANNING

[75] Inventors: Harro Träubel; Wilhelm Krümmel, both of Leverkusen; Joachim Kochta, Bonn, all of Germany

[73] Assignee: Bayer Aktiengesellschaft, Leverkusen, Germany

[21] Appl. No.: 309,219

[22] Filed: Sep. 20, 1994

Related U.S. Application Data

[63] Continuation-in-part of Ser. No. 214,874, Mar. 17, 1994, abandoned.

[30] Foreign Application Priority Data

Mar. 25, 1993 [DE] Germany ..... 43 09 688.3
Jun. 17, 1994 [DE] Germany ..... 44 21 292.5

[51] Int. Cl.[6] ..... C14C 3/18; C14C 3/28

[52] U.S. Cl. ..... 8/94.21; 8/94.22; 8/94.23; 8/94.33

[58] Field of Search ..... 8/94.2, 94.21, 94.22, 8/94.23, 94.18; 252/8.57; 427/389

[56] References Cited

U.S. PATENT DOCUMENTS

| | | | |
|---|---|---|---|
| 4,096,127 | 6/1978 | Schurmann et al. | 525/454 |
| 4,106,897 | 8/1978 | Traubel et al. | 8/94.33 |
| 4,106,898 | 8/1978 | Traubel et al. | 8/94.33 |
| 4,527,992 | 7/1985 | Friese et al. | 8/94.21 |
| 4,601,951 | 7/1986 | Fertell et al. | 427/389 |
| 5,124,181 | 6/1992 | Schaffer et al. | 427/323 |
| 5,306,435 | 4/1994 | Ishikawa et al. | 252/8.57 |

FOREIGN PATENT DOCUMENTS 372746 6/1990 European Pat. Off. .

*Primary Examiner*—Prince Willis, Jr.
*Assistant Examiner*—Alan D. Diamond
*Attorney, Agent, or Firm*—Joseph C. Gil; Richard E. L. Henderson

[57] ABSTRACT

The present invention relates to a process for retanning chrome-tanned leather comprising applying to leather a reaction product of (a) at least one glycerol monoester of a saturated $C_{12-18}$ monocarboxylic acid, (b) at least one diisocyanate selected from the group consisting of toluene diisocyanate, hexamethylene diisocyanate, and isophorone diisocyanate, and (c) dimethylolpropionic acid, wherein (i) the components (a), (b) and (c) are so selected that the molar ratio of the isocyanate groups of component (b) to the sum of the hydroxyl groups of components (a) plus (c) is about 0.5 to about 1.05 and (ii) the molar ratio of compound (c) to compound (a) is about 0.7 to about 1.5 and wherein (iii) the carboxyl groups originating from compound (c) are at least partly neutralized.

3 Claims, No Drawings

USE OF ESTER URETHANES FOR RETANNING

This is a continuation-in-part application of parent application Ser. No. 214 874, filed Mar. 17, 1994, now abandoned.

BACKGROUND OF THE INVENTION

This invention relates to the use of certain ester urethanes for retanning chrome-tanned leather. "Retanning" is understood to be the after-treatment of pretanned (generally chrome-tanned) leather in order to optimize color, levelness, softness, fullness, and behavior to water (hydrophobicity) and to fix tanning agents.

In addition to the group of so-called syntans, the most important retanning agents at present are carboxy-functional polymers in salt form; European Patent Applications 118,023 and 372,746 and German Offenlegungsschrift 3,931,039. However, polyurethanes optionally containing polyethylene oxide groups, ionic groups, or methylol groups have also been used for retanning; see German Offenlegungsschrift 2,504,081.

Hitherto known retanning agents do not satisfy all the expected requirements either because their hydophobicizing effect is inadequate or because they adversely affect feel, dyeability, grain pipeyness, or the subsequent finishing of the leather. The large number of desirable properties necessitates a compromise. Desirable retanning agents are those which optionally hydrophobicize the leather (i.e., make the leather impermeable to water without affecting its permeability to water vapor) but at the same time do not adversely affect feel, dyeability, grain pipeyness, and subsequent finishing.

It has now surprisingly been found that the use of ester urethanes having a certain composition in which no polyether groups are present provides the leather with a useful combination of desirable properties.

SUMMARY OF THE INVENTION

Accordingly, the present invention relates to a process for retanning chrome-tanned leather comprising applying to leather a reaction product of (a) at least one glycerol monoester of a saturated $C_{12-18}$ monocarboxylic acid, (b) at least one diisocyanate selected from the group consisting of toluene diisocyanate, hexamethylene diisocyanate, and isophorone diisocyanate ("IPDI"), and (c) dimethylolpropionic acid (i.e., 2-2-bis(hydroxymethyl)propionic acid), wherein (i) the components (a), (b) and (c) are so selected that the molar ratio of the isocyanate groups of component (b) to the sum of the hydroxyl groups of components (a) plus (c) is about 0.5 to about 1.05, (preferably 0.8 to 1.0) and (ii) the molar ratio of compound (c) to compound (a) is about 0.7 to about 1.5, preferably 0.8 to 1.2 and wherein (iii) the carboxyl groups originating from compound (c) are at least partly neutralized.

DETAILED DESCRIPTION OF THE INVENTION

The ester urethanes to be used in accordance with the invention may be prepared, for example, by reaction of the glycerol ester (a) with the diisocyanate (b) and reaction of the resulting addition compound with the diol compound (c) (that is, dimethylolpropionic acid, also known as 2,2-bis(hydroxymethyl)propionic acid).

The carboxyl groups of dimethylolpropionic acid may be neutralized before or after the reaction of compound (c). Suitable neutralizing agents include alkali and alkaline earth metal hydroxides, carbonates, and hydrogen carbonates, such as sodium hydroxide, potassium hydroxide, sodium carbonate, sodium hydrogen carbonate, potassium carbonate, magnesium hydroxide, calcium hydroxide, and barium hydroxide, and ammonia and primary, secondary and tertiary amines containing 1 to about 30 (preferably 3 to 18) carbon atoms, such as methylamine, ethylamine, propylamine, isopropylamine, butylamine, isobutylamine, hexylamine, cydohexylamine, methylcyclohexylamine, 2-ethylhexylamine, octylamine, isotridecylamine, tallow fatty amine, stearylamine, oleylamine, dimethylamine, diethylamine, dipropylamine, diisopropylamine, dibutylamine, diisobutylamine, dihexylamine, dicyclohexylamine, dimethyicyclohexylamine, di-(2-ethylhexyl)amine, dioctylamine, diisotridecylamine, di(tallow fatty)amine, distearylamine, dioleylamine, ethanolamine, diethanolamine, propanolamine, dipropanolamine, and morpholine. Preferably at least 50% (more preferably at least 80%) of the carboxyl groups originating from component (c) are neutralized.

The reactions may take place in the presence or absence of organic solvents. Preferred organic solvents are inert to the starting compounds used and include, for example, acetone, methyl ethyl ketone, tetrahydrofuran, dichloromethane, chloroform, perchloro-ethylene, ethyl acetate, dimethylformamide, and dimethyl sulfoxide.

The reaction of compounds (a) and (b) can be catalyzed, for example, by cobalt naphthenate, zinc octoate, dibutyltin dilaurate, dibutyltin diacetate (preferably dibutyitin dilaurate or dibutyltin diacetate) and by tertiary amines, such as triethyl amine or 1,4-diaza[2.2.2]-bicydooctane.

The ester urethanes to be used in accordance with the invention may be dispersed in water, for example, by adding the neutralizing agent in the form of an aqueous solution and then removing any organic solvent present. The ester urethanes are best used in the form of aqueous preparations having an ester urethane content of about 1 to about 40% by weight. They are used in a quantity of about 0.2 to about 10% by weight (ester urethane solid), based on shaved weight of the leather.

The ester urethanes to be used in accordance with the invention are excellently absorbed from the liquor onto the leather and make the leather hydrophobic and soft, as well as resistant to grain cracking, without adversely affecting its dyeability.

The following examples further illustrate details for the process of this invention. The invention, which is set forth in the foregoing disclosure, is not to be limited either in spirit or scope by these examples. Those skilled in the art will readily understand that known variations of the conditions of the following procedures can be used. Unless otherwise noted, all temperatures are degrees Celsius and all percentages are based on the pared weight of the leather and dilution ratios are based on weight. All commercial products (unless otherwise identified) are commercial products of Bayer AG, Leverkusen.

EXAMPLES

Preparation of an ester urethane for use in accordance with the invention.

A heatable 500-ml capacity three-necked round-bottomed flask equipped with a stirrer, reflux condenser, a drying tube, and a dropping funnel was used as the reaction vessel. After 17.9 g (0.05 mol) of glycerol monostearate were introduced into the flask, 45 mg dibutyltin diacetate, 50 ml anhydrous acetone, and 14.72 ml (17.9 g, 0.1028 mol) of 2,4-/2,6-toluene diisocyanate (isomer ratio of 80:20) were then successively added and the mixture was heated for 30 minutes to the boiling temperature. 11.75 g (0.05 mol) of the triethylamine salt of 2,2-bis(hydroxymethyl)propionic acid dissolved in 50 ml of anhydrous acetone were then added dropwise over a period of 10 minutes. After a reaction time under reflux of I hour, formation of the ester urethane was terminated. The solution was clear, moderately viscous, and pale yellow in color. For dispersion. 250 ml of deionized water were then added dropwise while maintaining a gentle reflux of the acetone. Removal of the acetone by vacuum distillation left an approximately 17% clear solution of the ester urethane.

Example 1

Automobile upholstery leather from wet blues a) Comparison:

2.4 kg of a pared chrome-tanned leather (pared thickness 1.1 mm) were treated for 30 minutes with 250% (based on pared weight) of water at 40° C., 0.5% of an 8.5% aqueous formic acid, 0.1% of a neutral emulsifier (BAYMOL ® AN flüssig (liquid) diluted with water in a ratio of 1:5) and 2% of a light-stable tanning agent (TANIGAN ® 3 LN). After the liquor had been drained off, the leather was rinsed for 10 minutes with 300% water at 40° C., after which the liquor was again drained off. The actual retanning process began with 150% water at 40° C., 1% of a 33% basic chrome tanning agent (CHROMOSAL ® B) and 3% of a neutralizing mixed chrome/syntan tanning agent (BLANCOROL ® RC). After 45 minutes, 7% CHROMOPOL ® AFS (Stockhausen) diluted beforehand with water in a ratio of 1:4 were added and, after 30 minutes, another 1.5% of a neutralizing synthetic tanning agent (TANIGAN ® PAK-N), 4% of a light-stable substitute tanning agent (TANIGAN ® LD-N) and 3% of a resin-based tanning agent (RETINGAN ® R7) were added and the leather was treated for another 15 minutes. In this Comparison Example, the leather was then treated for 45 minutes with 2% of an acrylate tanning agent (BAYTIGAN ® AR diluted beforehand with water in a ratio of 1:3). The liquor had a pH of 5.3. 1.5% sodium formate and 0.5% sodium carbonate were then added, after which the leather was treated for another 40 minutes (pH of liquor now being 6.1 ). The cross-section of the leather with bromocresol green was now blue. After another 40 minutes, the leather was washed for 10 minutes with 300% water at 44° C., the liquor was drained off, and dyeing was commenced as follows:

After 5 minutes in a 30% water at 25° C. and 0.8% ammonia (25% aqueous solution diluted beforehand with water in a ratio of 1:5), a mixture of 2% of a light-stable dispersing auxiliary tanning agent (BAYKANOL ® SL), 3% of a light-stable yellow metal complex dye (BAYGENAL ® Beige L-NGR) and 0.3% of a light-stable metal complex dye (BAYGENAL ® Grau L-NG) were added. After 30 minutes, 10% CHROMOPOL ® AFS (diluted beforehand with water in a ratio of 1:4) were added; after another 30 minutes, 150% water at 70° C. were added; and after another 5 minutes, another 2% BAYTIGAN ® AR (diluted beforehand with water in a ratio of 1:3) were added. After 30 minutes, 2.5% formic acid (85% aqueous solution diluted in a ratio of 1:10 and 1.25% in two portions) was added for 20 minutes (liquor pH now being 4.12) and the liquor was drained off. The leather was then washed once more (with 300% water at 40° C.) and after 10 minutes was rinsed for 10 minutes with water at 25° C. with the cover removed. The leathers were then removed, wet-stretched and dried, conditioned, staked, milled and stretched, and then evaluated.

b) According to the invention:

The BAYTIGAN ® AR was replaced by the ester urethane used in accordance with the invention, all other process parameters remaining constant. Evaluation of the two leathers produced the following results:

The comparison leather produced in accordance with the prior art was not quite as soft as the leather in accordance with the invention. The grain fall of the leather according to the invention was distinctly better than that of the comparison leather. When a drop of water was applied to the comparison leather, it immediately sank into the leather whereas for the brown leather produced in accordance with the invention water penetrated only slowly into the substrate after some time.

Example 2

Skiver a) Comparison:

Eight 1.3 mm thick wet blue split halves that had been chrome tanned were washed for 10 minutes in water at 50° C. (200%) and the liquor was discarded. 100% (based on pared weight) of water at 40° C., 2% of a neutralizing synthetic tanning agent (TANIGAN ® PAK-N), and 0.5% sodium bicarbonate were then added. After another 90 minutes, the pH was 5.82.

Preliminary oiling was started with 2% of a synthetic oil (CORIPOL ® DX 902 (Stockhausen) diluted beforehand with water in a ratio of 1:4) and continued for 15 minutes. The leather was then retanned as follows:

2% of a partly neutralized polyacrylic acid (BAYTIGAN ® AR diluted beforehand with water in a ratio of 1:3) and 1.5% of an acidic polyether ester (LEVOTAN ® C) were added. After another 45 minutes, 6% of a synthetic light-stable substitute tanning agent (TANIGAN ® LD-N) were added. After another 15 minutes, the pH was 5.36. 0.5% formic acid (85% diluted beforehand with water in a ratio of 1:10) were then added and after 15 minutes the liquor was drained off (pH 4.6). The leather was washed for 10 minutes with 200% water at 60° C. and the liquor was discarded. The leather was then oiled as follows: 100% water (60° C.), 6% of a light-stable synthetic oil (CORIPOL ®DX 902) mixed with 1% of a synthetic neatsfoot oil substitute (CORIPOL ® ICA) were left in contact with the leather for 45 minutes. The pH was 4.62. 1.5% of an acrylate binder (EUDERM ® Grund 25A diluted beforehand with water in a ratio of 1:4) was then added and after 30 minutes the liquor was acidified with 0.5% formic acid (85%, diluted with water in a ratio of 1:10). After 20 minutes, the pH was 4.

The leather was then rinsed for 5 minutes with water at 20° C., after which the leathers could be removed. After drying in vacuo for 3 minutes at 70° C., the leathers were hung out to dry, conditioned, staked, aired, and then restaked.

Part of the leathers were then coated with LEVACAST® (two-component reactive coating of leathers with an isocyanate prepolymer and a partly blocked oligomeric curing agent in methyl ethyl ketone solution applied by the reversal process).

b) According to the invention:

Example 2 (a) was repeated with 3.5% of the ester urethane to be used in accordance with the invention instead of the partly neutralized polyacrylic acid (BAYTIGAN® AR).

The comparison skiver that had been produced in accordance with the prior art and tested after 24 hours was distinctly harder than the skiver according to the invention. After 24 hours, the same leathers subsequently coated with LEVACAST® showed a better grain fall in the case of the leather according to the invention than in the case of the comparison leather. Grain fall is the behavior of a leather on folding. A good grain fall is distinguished by the fact that only small creases appear when the leather is folded.

The leather produced in accordance with the prior art was more hydrophilic than the leather according to the invention. In the case of the comparison leather, a drop of water immediately sank into the substrate. Leather produced in accordance with the invention held the drop of water for a relatively long time. Surprisingly, however, this effect did not adversely affect the adhesion of the coating subsequently applied.

What is claimed is:

1. A process for retanning chrome-tanned leather comprising applying to leather a reaction product of (a) at least one glycerol monoester of a saturated $C_{12-18}$ monocarboxylic acid, (b) at least one diisocyanate selected from the group consisting of toluene diisocyanate, hexamethylene diisocyanate, and isophorone diisocyanate, and (c) dimethylolpropionic acid, wherein (i) the components (a), (b) and (c) are so selected that the molar ratio of the isocyanate groups of component (b) to the sum of the hydroxyl groups of components (a) plus (c) is 0.5 to 1.05 and (ii) the molar ratio of compound (c) to compound (a) is about 0.7 to about 1.5 and wherein (iii) the carboxyl groups originating from compound (c) are at least partly neutralized.

2. A process according to claim 1, wherein the molar ratio (i) is 0.8 to 1.0.

3. A process according to claim 1, wherein the molar ratio (ii) is 0.8 to 1.2.

* * * * *